United States Patent [19]

Fukushima

[11] 4,046,504

[45] Sept. 6, 1977

[54] PROCESS FOR PREPARATION OF COLORED SUEDE SHEET MATERIALS

[75] Inventor: Osamu Fukushima, Okayama, Japan

[73] Assignee: Kuraray Co., Ltd., Kurashiki, Japan

[21] Appl. No.: 624,133

[22] Filed: Oct. 20, 1975

[30] Foreign Application Priority Data

Oct. 23, 1974 Japan ..... 49-122233

[51] Int. Cl.[2] ..... D06P 7/00

[52] U.S. Cl. ..... 8/17; 8/4; 8/21 A; 8/21 B; 8/21 C; 8/21 D; 8/54.2; 8/162 S; 28/217; 28/247

[58] Field of Search ..... 8/17, 4, 21 A, 21 B, 8/21 C, 21 D, 54.2, 15, 30, 72, 162 S, 162 R; 260/37 NP; 264/78; 28/75 R

[56] References Cited

U.S. PATENT DOCUMENTS

| | | | |
|---|---|---|---|
| 2,345,533 | 3/1944 | Graves | 18/55 |
| 2,716,585 | 8/1955 | Bailey | 8/14 |
| 2,893,970 | 7/1959 | Caldwell et al. | 260/45.4 |
| 3,067,483 | 12/1962 | Hollowell | 28/80 |
| 3,899,292 | 8/1975 | Okazaki et al. | 8/17 |
| 3,969,312 | 7/1976 | Lees | 260/40 P |

*Primary Examiner*—John Kight, III
*Attorney, Agent, or Firm*—Barry Kramer

[57] ABSTRACT

In a process for preparing suede sheet materials having desirable tactile characteristics and good coloring, fibers are colored with a dope dye before being formed into a fibrous mat. The mat is impregnated with a binder and subsequently treated to produce a sheet material having a napped surface. The sheet material is then dyed to obtain the product.

11 Claims, No Drawings

PROCESS FOR PREPARATION OF COLORED SUEDE SHEET MATERIALS

BACKGROUND OF THE INVENTION

The present invention relates to a process for preparing suede sheet materials which feel soft and are attractively colored. More particularly, the invention relates to a process for dyeing densely or clearly, without damage to tactile properties, a suede sheet material comprising a fibrous mat and a binder composed mainly of an elastomer, on the surface of which a nap of fibers is formed by buffing, brushing or carding.

Known suede sheet materials are generally divided into two types. One type is formed by buffing the surface of a porous film composed of an elastomer to expose a porous polymeric layer. Suede sheet materials of this type are disclosed in, for example, U.S. Pat. No. 3,483,015, U.S. Pat. No. 3,616,023, U.S. Pat. No. 3,567,535, U.S. Pat. No. 3,284,274 and U.S. Pat. No. 3,429,727.

Another type is formed by impregnating a fibrous mat with an elastomeric binder, coagulating the elastomer to form an impregnated mat and buffing the impregnated mat to form a nap of fibers at the surface. Suede sheet materials of this latter type are disclosed in, for example, U.S. Pat. No. 3,067,482 and British Pat. No. 914,712.

In suede sheet materials of the former type, the nap is solely an elastomeric material which does not have surface scratch resistance sufficient to permit the sheet material to be effectively used as a leather substitute. In addition, suede sheet materials of the former type do not feel like genuine suede material, cannot be deeply colored and do not show a clear writing effect. The writing effect is the visual effect which occurs when the lay of the nap is changed. Surface characteristics such as color hue and luster are changed according to the viewing angle.

In suede sheet materials of the latter type, the fibrous nap exhibits a very high surface scratch resistance. Further, the use of finer fibers in the nap brings about advantages. For example, the surface feels more like genuine suede. Also where a suede sheet material is formed by using mixed-spun fibers and one component of the mixed-spun fibers is extracted, the nap of the remaining ultra-fine fibers has excellent tactile properties and shows a clear writing effect.

However, suede sheet materials of the latter type have a serious drawback. Since the sheet material is a composite material of two materials having different properties; namely, a fibrous material which constitutes the nap and an elastomeric material which constitutes the binder for the sheet material, applying surface coloring by dyeing or the like produces an unevenly colored finish due to differences between the two materials in chemical properties such as dyeability, color development and color fastness.

Further, if the fibers in the nap become too fine (for example, 0.1 denier or finer) good color development cannot be obtained in the fiber component when the suede sheet material is dyed. Therefore, the suede sheet material cannot be colored densely and clearly.

If the size of the fibers is further reduced below 0.07 denier, extreme color unevenness or scattering is caused and island-like patterns occur across the surface. The commercial value of such unevenly colored material is drastically lowered.

Poor color development of the fibers may be improved in some cases by dyeing the fibers more densely. However, if only the fibers are dyed densely; the color has a tendency to fade when subjected to rubbing, washing or light. Moreover the surface becomes hard and a good writing effect and a desirable tactile cannot be obtained.

To at least partially eliminate such defects in suede sheet materials of the latter type, a pigment may be incorporated in advance into the elastomer to be impregnated in the fibrous mat. However, when this method is applied on an industrial scale, it is very difficult to frequently change pigments. Accordingly, although mass production of suede sheet material of the same color is possible, production of small quantities of a variety of products, which is standard practice in industries using this type of material, cannot be accomplished conveniently. This method has the further drawback that color matching is very difficult even if a post dyeing technique is adopted. Moreover, when the thickness of the nap-constituting fibers is reduced, the fibers do not accept dye as well as the elastomer and appear rather whitish against the background of the elastomer.

Another method for overcoming some of the foregoing defects is to use two different dyes having good color development properties for the nap and the binder component, respectively. The dyeing operation is conducted twice. With this method, however, color matching is very difficult, although a product having a good color development can be obtained. Further, this method provides no substantial solution to the above-mentioned problems caused by reduction of the fiber fineness.

Where a suede sheet material has ultrafine (e.g. smaller than 0.07 denier) fibers of various thickness, the above-mentioned dyeing method cannot prevent the occurance of uneven dying amoung the fibers. Color scattering is inevitably brought about, resulting in reduction of the commercial value of the material. The undesired phenomenon of color scattering is a serious defect of suede sheet materials of the latter type and cannot be overcome by any of the conventional methods.

SUMMARY OF THE INVENTION

It is a primary object of this invention to provide a process for preparing suede sheet materials, comprising a fibrous mat and a binder, which are colored densely and clearly without color unevenness or color scattering.

Another object of the present invention is to provide a process for preparing suede sheet materials comprising a fibrous mat and a binder, in which, a nap of fine fibers may be employed while retaining good physical properties required of suede sheet materials, such as good feeling, high flexibility, good touch and good writing effect, and while maintaining good coloring characteristics such as dyeability, color development and color fastness without uneven color.

Still another object of the present invention is to provide a process for preparing suede sheet materials which have the above-mentioned excellent properties and which are further characterized by a lack of color scattering even where the fibers are of different deniers.

It has been surprisingly found that when a fibrous mat composed of fibers which have been colored throughout is used as a nap-constituting fiber component and this fibrous mat is subjected to the dyeing treatment, the foregoing problems can be greatly moderated.

More specifically, in accordance with the present invention, a process for preparing suede sheet materials which have acceptable tactile and color properties includes the steps of dyeing the fibers to be used in a fibrous mat in advance throughout the fibers, impregnation the fibrous mat with a binder composed mainly of an elastomer and dyeing the sheet material after the nap of fibers is formed on the surface of the sheet material.

DESCRIPTION OF SPECIFIC EMBODIMENTS

The fibers which are colored throughout in advance are preferably spun-dyed fibers. Such fibers are filaments or staple fibers formed by using known spinning methods to spin molten particulate polymers or a spinning solution into which at least one organic or inorganic pigment or dye (referred to as "dope dye") has been introduced. The spun-dyed fibers are then, drawn, crimped or cut, if desired.

The dope dyes which are preferably employed include inorganic pigments such as carbon black, chrome yellow, cadmium yellow, iron oxide, umber, red lead, cobalt violet, ultramarine, cobalt blue, cerulean blue, chrome green, chromium oxide and various metal powder pigments, and organic pigments such as azo compounds, phthalocyanine and metal chelate compounds. Use of white pigments such as titanium oxide, zinc white and the like is not preferred, because clear or dense colors are hard to obtain.

The dope dyes are used in an amount of 0.5 to 15% by weight, preferably 1 to 12% by weight, based on the nap-constituting fibers. In order to eliminate color unevenness caused by the use of different materials and in order to provide clear and dense colors while retaining other desirable properties, it is important that the dope dyes should be used in the above-mentioned amounts. If the amount of the dope dyes exceeds 15%, the tenacity of the fibers is drastically lowered and a good luster cannot be obtained, although dense color can be obtained. If the amount of the dope dye is smaller than 0.5% by weight, it becomes difficult to eliminate, for example, uneven coloring or color differences.

The amount of dope dye to be added is chosen within this range depending on the fiber denier and the coloring objectives. For example, in the case of fine denier fibers or modified fibers, the amount of the dope dye is higher in the range. Further, if dense dyeing is desired, the amount of the dope dye is also higher. Where colors to be matched differ greatly from the color of the dope dye, the amount of the dope dye is relatively lower in the range, even if dense dyeing is desired.

The "fibrous mat" referred to above is a web formed from fibers by a wet or dry method or a web formed by depositing filaments in a sheet-like form on a collector without winding them. According to need, such a web may be needle-punched from one surface or both the surfaces thereof or a fluid may be jetted on one or both surfaces of the web to entangle the fibers. The use of a web in which fiber entanglements are formed by such needle punching or fluid jetting is especially preferred in the present invention. The fibrous mat to be used in the present invention may also include a woven fabric capable of forming a nap of fibers.

The starting sheet material of the present invention is formed by impregnating the fibrous mat with a binder solution or dispersion containing an elastomer and by coagulating the binder by treatment in a non-solvent or by evaporating the solvent or dispersant by heating. Fibers are raised on the surface of the resulting sheet material by buffing or brushing to create the napped surface.

The intended product of the present invention can be obtained by dyeing the prepared suede sheet material with a known dye. At this dyeing step, conventional dyes and ordinary dyeing methods can be adopted without any modification being made thereto. For instance, dyeing is accomplished in an aqueous solution or organic solvent by using a winch, a dyeing jig or a high pressure vessel. According to need, a carrier may be used at this dyeing step. The type of dye employed is not particularly critical and any dye can be used. Further, a dye of the same color as that of the dope dye which was used for coloring fibers may be used at this dyeing step, or a dye of a color different from that of the dope dye coloring. For example, where fibers were colored with carbon black and the suede sheet material is dyed with a black dye, a leather-like sheet material having a deep black color and excellent color fastness can be obtained. Further, even if fibers are colored with carbon black, products dyed in a dark brown color, a dark green color or a wine color can easily be obtained.

According to the present invention, since naps of a sheet material with previously colored fibers are dyed, a suede sheet material having particularly desirable tactile properties can be obtained.

Still further, according to the present invention, even a suede sheet material composed of fibers having a size finer than 0.1 denier can be colored densely without reduction of tactile characteristics of a suede sheet material. Furthermore, defects observed in conventional products composed of ultrafine denier fibers (having a size finer than 0.07 denier) such as color scattering and island-patterns, can be substantially eliminated, and a suede sheet material free of such defects can be conveniently prepared even where ultrafine denier fibers are employed.

The process of the present invention has still another advantage. Even where ultrafine denier fibers obtained by the mixed-spinning described below are employed, occurrence of color scattering normally owing to the uneven denier among fibers can be substantially prevented.

However, when the fiber size is extremely lowered, (for example, to 0.0005 denier or smaller) sufficient nap strength and the intended effects of the present invention cannot be attained sufficiently. Therefore, use of such fibers is not preferred. In view of the foregoing, it is especially preferred that fibers having a size of 0.07 to 0.001 denier be used in the invention.

A suede sheet material composed of fine denier fibers or ultrafine denier fibers, which is effectively used in the present invention, is prepared, for example, according to the following method.

At least two polymers having different solvent solubility are melted in different melting systems and the melts are spun while forming mixed streams by control of spinnerets according to the so-called composite spinning method, whereby mixed fibers are prepared. Alternately, mixed fibers are prepared according to the so-called mixed spinning method by mixing and melting two or more different polymers or by melting them in different melting systems and combining streams of polymer melts, and then spinning the resulting mixed streams of the polymers. These mixed fibers are characterized in that at least one polymer (component A) is dispersed in the form of a plurality of ultrafine denier fibers in the other polymer (component B). A fibrous mat is prepared from such mixed fibers according to a method as described above. At an optional stage during the process of preparing a suede sheet material from this fibrous mat, only the component B in the mixed fibers is extracted and removed. In general, it is preferred to adopt a method in which the component B is extracted and removed by using a solvent capable of dissolving the component B alone selectively, after impregnation and coagulation of a binder composed mainly of an elastomer.

In case the viscosity of an impregnating liquid, a solution or dispersion of an elastomer, is too high, deformation occurs in a fibrous mat which is impregnated, making the impregnation operation difficult. The quality of the resulting product is degraded. Prior to the impregnation operation in the present invention, the fibrous mat is fixed with a polymeric substance or thermoplastic polymer having a lower melting point which differs from the mat-constituting fiber and the binder with respect to the solvent solubility. The form of the fibrous mat can then be maintained during the impregnation and coagulation steps. In the final product, a part or all of the polymeric substance used for stabilizing the mat form may be removed if desired to release the fibers, whereby a leather-like sheet material which feels firm but soft can be obtained.

In the present invention, a dye acceptance promoting substance may be incorporated into the elastomer to be impregnated in the fibrous mat. For example, at least one member selected from a polyurethane containing polyethylene ether glycol, a dyeability-improved polyurethane, a crosslinked polyurethane, a modified polyamide, a nitrogen-containing polymer such as polyvinylpyrrolidone, a polyacrylonitrile, a polyamine, sulfonated polymer and derivatives thereof may be incorporated in the elastomer in an amount of up to 50% by weight, preferably 5 to 30% by weight, based on the elastomer.

However, when such dye acceptance promoting substance is used, color differences may be emphasized in the dye-finished state or properties as suede sheet material may be degraded. Accordingly, it is preferred that preliminary tests be conducted to determine whether a dye acceptance promoting substance should be used or not, or to select an optimum amount of such substance.

Ordinary fiber-forming polymers can be used for formation of nap-constituting fibers. For example, there can be preferably employed polyamides such as nylon-6, nylon-66, nylon-610, nylon-8 and nylon-12, polyesters such as polyethylene terephthalate, polybutylene terephthalate and copolymers thereof, and polyolefins such as polyethylene, polypropylene and polybutylene. In addition, polyvinyl alcohol, polyvinyl chloride and derivatives thereof, and regenerated cellulose and cellulose acetate can be used.

As the component of the mixed fiber to be extracted (component B), there are employed ring-containing vinyl polymers such as polystyrene, poly-α-methylstyrene and polyvinyl-toluene, polyvinyl-pyrrolidone, polyurethanes and polyethers, in addition to the above-mentioned fiber-forming polymers.

As the elastomer binder (component C) to be impregnated in the fibrous mat, there can be employed, for example, polyurethane elastomers formed by reacting at least one polymer diol such as a polyester diol, polyether diol, polyester ether diol and polycaprolactone with an organic diisocyanate and a diol or diamine containing two active hydrogen atoms as a chain extender, synthetic rubbers such as acrylonitrile-butadiene copolymers, styrene-butadiene copolymers, polybutadiene and neoprene, natural rubber, and such polymers as polyacrylic acid esters. When it is desired to obtain a leather-like sheet material, use of a rubbery elastomer polymer composed mainly of a polyurethane elastomer is preferred. Such additives as a coagulation adjusting agent, an agent preventing adhesion with fibers, a dyeing promoting agent, a flame retardant, an antistatic agent and a colorant may be incorporated into a solution or dispersion of an elastomer as mentioned above according to need.

Embodiments of the present invention will now be described by reference to the following Examples that by no means limit the scope of the present invention. In these Examples, all of "parts" and "percentages" are by weight unless otherwise indicated.

EXAMPLE 1

A polyester containing 1% of carbon black was melt-spun, drawn, crimped and cut, and the resulting staple fibers having a size of 1.5 denier and a fiber length of 51 mm were formed into a random web. The web was needle-punched to obtain an entangled non-woven fabric. This entangled non-woven fabric was impregnated with a dimethylformamide (hereinafter referred to as "DMF") solution containing 15% of a polyester type polyurethane elastomer formed by polymerizing polyethylene adipate glycol, 4-4'-diphenylmethane diisocyanate and ethylene glycol, and was then coagulated in a coagulation bath, washed with water and dried to obtain a sheet material [I] having a thickness of 1.0 mm.

The surface of the sheet material [I] was buffed by sandpaper and then brushed to obtain a suede sheet material having naps of fibers formed on the surface thereof.

The formed sheet material was dyed under the following conditions:

Dye: black disperse dye composition, 4% owf.
Dispersant: Disper TL, 2 g/l
Carrier: Tetrosin F, 10 g
Bath ratio: 1 : 100
Temperature: 95° C.
Time: 60 minutes After completion of the dyeing, the dyed sheet material was washed for 20 minutes with a warm aqueous solution containing 1 g/l of sodium lauryl benzene-sulfonate, which was maintained at 70° C. Then, the sheet material was washed with warm water, dried and crumpled, and the napped surface was brushed to obtain a colored suede sheet material.

The resulting suede sheet material was colored a dense black color and felt soft. The material was excellent in color fastness when subjected to friction and washing.

For comparison, a suede sheet material was prepared in the same manner as described above except that carbon black was not incorporated into the fibers. The control material was dyed under the same conditions as above. The resulting suede sheet material was not considered acceptable, because a color difference was observed between the impregnated polyurethane and the fibers in the nap.

EXAMPLE 2

50 parts of nylon-6 mixed with 5% of a red pigment (component A) was mixed with 50 parts of polystyrene (component B), and the mixture was rendered molten in a single screw extruder. The molten mixture was spun while using nylon-6 as ultrafine denier fiber component. The spun fibers were drawn, crimped and cut to obtain mixed fibers having a size of 6.0 denier and a length of 51 mm (the number of filaments of the component A being about 500 per fiber bundle and the average size of the monofilaments of the component A being 0.006 denier). A web formed from the mixed fibers was needle-punched to obtain an entangled non-woven fabric. The non-woven fabric was impregnated with a 5% aqueous solution of polyvinyl alcohol and dried to fix the form of the non-woven fabric. Then the non-woven fabric was impregnated with a 13% DMF solution of a polyether type polyurethane elastomer containing a red organic pigment, and coagulated in a non-solvent to obtain an impregnated mat. The impregnated mat was treated in hot water and in perchloroethylene to remove the polyvinyl alcohol and polystyrene. Both surfaces of the resulting sheet material were buffed with sandpaper and further brushed in water to obtain a suede sheet material having a thickness of 0.75 mm.

The resulting sheet material was dyed under the following conditions:

Dye: red dye composition (product of Ciba Geigy), 6% owf.
Bath ratio: 1 : 100
Temperature: 90° C. (winch dyeing machine)
Time: 60 minutes After completion of the dyeing operation, the sheet material was washed for 20 minutes with warm water containing 1 g/l of sodium lauryl benzenesulfonate and then with warm water alone, and then was dried and crumpled. The napped surface was then brushed to obtain a suede sheet material having a deep red color with luster. The product was found to be highly useful as a quality clothing material and to have good color fastness.

For comparison, a suede sheet material (comparative product I) was prepared in the same manner as described above except that no red pigment was incorporated into the fibers. This material was dyed under the same conditions as above. The color of the resulting sheet material lacked deepness, and a color difference was observed between the impregnated polyurethane and the fibers in the nap. Further, color scattering was observed through the entire structure.

In order to obtain a satisfactorily deep color in the suede sheet material prepared by using non-dyed fibers, the sheet material was dyed by severely changing the dyeing conditions as follows:

Dye: same red dye composition as above, 10% owf.
Bath ratio: 1 : 150
Temperature: 97° C. (winch dyeing machine)
Time: 100 minutes The resulting product (comparative product II) was satisfactory in respect to the density of color but the clearness of color was drastically lowered. Further, the material felt hard and the color fastness was degraded.

Properties of the foregoing three suede sheet materials were tested to obtain results shown in Table 1.

TABLE 1

| | Fastness (grade) | | | Cantilever | | | |
|---|---|---|---|---|---|---|---|
| | Friction | Water Washing | Dry Cleaning | Softness (mm) | Touch | Color Density | Color Clearness |
| Product of Example 2 | 4.5 | 4 | 4 | 67 | good | good | good |
| Comparative Product I | 4.5 | 4 | 4 | 65 | good | shallow | marginally acceptable |
| Comparative Product II | 2 | 1.5 | 2 | 82 | poor (not uniform) | good | poor |

In an effort to obtain sufficient densely colored suede sheet material by using fibers which were colored throughout, without performing the second dyeing operation, in the manner described above, mixed fibers were prepared by using as component A nylon-6 into which 20% of the red pigment was incorporated and as the component B the same polystyrene as used above. However, neither good spinnability nor good stretchability could be obtained, and the resulting fibers failed to have a sufficient tenacity. Accordingly, a suede sheet material having a good nap could not be obtained from such fibers.

EXAMPLE 3

Nylon containing 3% of carbon black (component A) was melted in one melting system, and a pigment-free polyethylene (component B) was melted in another melting system. Both melts were combined to form mixed streams in a mixing ratio of 50:50 in which the nylon was dispersed as the ultra-fine fiber component in the dispersion medium of the polyethylene. In this state, both the polymers were spun. The spun fibers were drawn, crimped and cut to obtain staple fibers having a size of 4.0 denier and a fiber length of 51 mm. The staple fibers were formed into a cross-lap web, and the web was needle-punched to obtain an entangled non-woven fabric. The resulting non-woven fabric was treated in a hot air heating zone maintained at 135° C. and then impregnated with a 13% DMF solution of a blend polyurethane elastomer comprising 90 parts of a polyester type polyurethane and 10 parts of a polyether type polyurethane. The impregnated non-woven fabric was coagulated in a non-solvent coagulation bath and washes with water to obtain a sheet material [II] in which the fiber-constituting polyethylene component B had been removed and the nylon component A left as the ultra-fine fiber component in the form of a bundle composed of 30 (on the average) monofilaments (the monofilament size being 0.07 denier).

The resulting sheet material [II] was divided into two portions horizontally substantially at the center of the thickness. The resulting two sheets were buffed and brushed to form a nap of fibers. The suede sheet materials obtained had a thickness of 0.75 mm.

The resulting suede sheet material was dyed in a dyeing bath containing Ortolan Black (manufactured by BASF) and Kayakalan Black (manufactured by Nippon Kayaku) to obtain a calf-like suede sheet material having a deep color and a luster but being free of a color difference. The product was found to have excellent color fastness and a good writing effect. This product was especially suitable as a suede clothing material.

For comparison, a suede sheet material was prepared in the same manner as described above except that carbon black was not incorporated in nylon. The resulting sheet material was dyed under the same conditions as described above. Because the fines were ultrafine good color development was not obtained. A deep black color was not manifested on the product.

EXAMPLE 4

A suede sheet material [III] was prepared in the same manner as described in Example 3 except that the amount of carbon black incorporated into the nylon was changed to 5%, and this suede sheet material was dyed in a dyeing bath containing Lany Yellow (manufactured by Sumitomo Kagaku) and Irgaran Dark Brown (manufactured by Ciba Geigy) to obtain a suede sheet material having a deep dark brown color with excellent color fastness. The product felt firm but soft and draped well, making it very suitable as a suede clothing material.

EXAMPLE 5

The suede sheet material [III] prepared in Example 4 was dyed with a dye composition comprising a red dye, a yellow dye and a rubin dye (manufactured by Ciba Geigy). A suede sheet material having a beautiful wine color was obtained. This material had acceptable color fastness and could be used effectively as a suede clothing material.

For comparison, a suede sheet material prepared using non-colored fibers was dyed under the same conditions as above. A product having a deep wine color could not be obtained, and a color difference was conspicuous in the resulting dyed sheet.

EXAMPLE 6

A suede sheet material was prepared in the manner as described in Example 3 except that the amount of carbon black incorporated into nylon was changed to 1%. This suede sheet material was dyed with a dye composition comprising Lanasyn Green (manufactured by Mitsubishi Kasei) and Vialon Fast Yellow (manufactured by BASF). The resulting suede sheet material had a beautiful green color.

EXAMPLE 7

A polyester mixed with 10% of carbon black was melted in one melting system and a pigment-free polyethylene was melted in another melting system. Both the melts were spun by controlling flows of the melts by spinnerets so that the polyester was dispersed as the ultrafine fiber component and the polyethylene was present as the dispersion medium. The spun fibers were drawn, crimped and cut to obtain staple fibers having a size of 3.0 denier and a fiber length of 51 mm. The staple fibers were formed into an entangled non-woven fabric which was heat-treated in a heating zone maintained at 135° C. to shrink and fix the fibers. The fixed non-woven fabric was impregnated with a dispersion comprising 95 parts of a dispersion of a polyester-type polyurethane and 5 parts of a dispersion of a modified polyamide. The impregnated fabric was dried to deposit the polymers on the fibers. The polyethylene was then removed to obtain a sheet material [IV] in which the polyester component was left in the form of a bundle composed of 150 (on the average) ultrafine denier fibers having an average size of 0.01 denier. The sheet was divided into two portions horizontally substantially at the center of the thickness. The two sheets were buffed and brushed to obtain suede sheet materials.

The resulting suede sheet material was dyed at a high temperature with a black dye composition to obtain a suede sheet material having a deep black color and a good writing effect. It was very suitable as a suede clothing material.

For comparison, a suede sheet material was prepared in the manner described above except that carbon black was not incorporated into the polyester. The sheet material was dyed under the conditions described above. The color development of the fibers was very poor, and the resulting product did not have a black color but rather a dark blue color. Color scattering was not observed. The amount of the dye was increased and dyeing conditions were changed in various manners. However, a suede sheet material having a deep black color could not be obtained. When the amount of the dye was increased, the surfaces of fibers were densely covered with the dye and color fastness was degraded.

EXAMPLE 8

A polyester mixed with 3% of Chrome Phthal Red was melt-spun at a high speed by using air jet streams, and the spun filaments were collected on a wire gauge to obtain a web having a unit weight of about 100 g/m$^2$. The filaments had a size of 0.06 denier.

Three of such webs were piled, and the assembly was needle-punched and heat-treated to obtain an entangled non-woven fabric. The non-woven fabric was impregnated with a 6% aqueous solution of a water-soluble polyvinyl alcohol and then dried to obtain a non-woven fabric in which respective fibers were fixed.

The dried non-woven fabric was impregnated with a dimethylformamide solution of a polyurethane composition comprising approximately 85 parts of a polyester type polyurethane, 15 parts of a polyethylene ether type polyurethane and 0.5 part of a non-ionic surface active agent. The impregnating composition was coagulated in a non-solvent coagulation bath before the fabric was washed with water and dried. The resulting sheet material was buffed to obtain a suede sheet material. The sheet material was dyed in the presence of a carrier with a dye composition comprising Fast Red (manufacutured by I.C.I.), Red (manufactured by I.C.I.) and Brilliant Yellow (manufactured by I.C.I.). The resulting suede sheet material had a deep beautiful red color and was suitable for production of women's shoes.

EXAMPLE 9

A mixture of 55 parts of polyester mixed with 5.5% of Chrome Phthal Red and 45 parts of polyethylene was melted in a single screw-type extruder and spun so that the polyester was dispersed as an ultrafine fiber component with the polyethylene acting as the dispersion medium. The spun fibers were drawn, crimped and cut to obtain staple fibers having a size of 4.0 denier and a fiber length of 51 mm. The staple fibers were formed into a web, and the web was needled-punched to form a non-woven fabric. The non-woven fabric was heat-treated, impregnated with the same DMF solution of a polyurethane composition as used in Example 8, coagulated, washed with water and dried. Then, the polyethylene component of the fiber was extracted to obtain an entangled non-woven fabric in which the polyester component was left in the form of a bundle of ultra fine denier fibers having an average size of 0.0025 denier. The resulting sheet material was divided into two portions horizontally substantially at the center of the thickness. The two sheets were buffed to form a nap of fibers, and dyed in the presence of a carrier with a red dye composition. The resulting suede sheet materials had a deep beautiful red color and a good writing effect.

When sheet materials prepared as above were dyed with a dye composition comprising a yellow dye and an orange dye while changing the mixing ratio of the two dyes, there were obtained a yellow suede sheet material and an orange suede sheet material, each of which was excellent in the clearness and deepness of the color and was suitable as a clothing material.

For comparison, a sheet material was prepared in the manner described above except that a pigment was not incorporated into the polyester. The sheet material was dyed under the conditions as described above. The coloring property of the fibers was extremely poor, and a conspicuous color difference was observed between the polyurethane and the fiber.

What is claimed is:

1. A process of preparing suede sheet materials having desirable tactile characteristics and good coloring comprising the steps of:

a. coloring fibers throughout with dope dyes;
b. forming said colored fibers into a fibrous mat;
c. impregnating said mat with a binder composed mainly of an elastomer;
d. treating said impregnated mat to form a napped surface thereon, the size of the fibers in the resulting nap ranging from 0.1 to 0.0005 denier; and
e. dyeing the napped sheet material.

2. A process for preparing suede sheet material according to claim 1 wherein the colored fibers in said fibrous mat comprise 0.5 to 15% by weight of a dope dye.

3. A process for preparing suede sheet materials according to claim 2 wherein the size of the fibers in the resulting nap is 0.07 to 0.001 denier.

4. A process for preparing suede sheet materials according to claim 2 wherein the fibers to be formed into the fibrous mat is made of at least one polymer selected from the group consisting of polyamides, polyesters, polyolefins, acrylonitrile polymers, polyvinyl alcohols, vinyl chloride polymers, regenerated cellulose and cellulose acetate.

5. A process for preparing suede sheet materials according to claim 2 wherein the fiber to be formed into the fibrous mat is made from at least one polymer selected from the group consisting of polyamides, polyesters, polyolefins and acrylonitrile polymers.

6. A process for preparing suede sheet materials according to claim 2 wherein the elastomer to be used in the binder is at least one member selected from the group consisting of polyurethane elastomers, acrylonitrilebutadiene copolymers, styrene-butadiene copolymers, butadiene polymers, neoprene, natural rubber and polyacrylic acid esters.

7. A process for preparing suede sheet materials according to claim 2 wherein the elastomer in the binder is a polyurethane elastomer.

8. A process for preparing suede sheet materials according to claim 2 wherein a dye-accepting promoting substance is incorporated into the elastomer in the binder is an amount of up to 50% by weight.

9. A process for preparing suede sheet materials having desirable tactile characteristics and good coloring which comprises the steps of:

a. forming a fibrous mat from mixed fibers in which a polymer (component A) containing 0.5 to 15% by weight, based on the polymer, of a dope dyes is dispersed in the form of a plurality of fine denier fibers in a polymer (component B) having a solvent solubility different from that of the polymer component A;
b. impregnating the fibrous mat with a binder composed mainly of an elastomer;
c. coagulating the impregnated fibrous mat;
d. treating the fibrous mat with a solvent capable of dissolving the component B selectively to remove component B from the mixed fibers, to produce a binder-impregnated sheet material;
e. forming a nap of fibers on the surface of said sheet material, and
f. dyeing the napped sheet material.

10. A process for preparing suede sheet materials according to claim 9 wherein the fibers in the fibrous mat are mixed spun fibers.

11. A process for preparing suede sheet materials according to claim 2 wherein the dope dye is at least one member selected from the group consisting of carbon black, chrome yellow, cadmium yellow, iron oxide, umber, red lead, cobalt violet, ultramarine blue, cobalt blue, cerulean blue, chrome green, chromium oxide, metal pigments, azo compounds, phthalocyanine compounds and metal chelate compounds.

* * * * *